US006491485B2

(12) United States Patent
Zavitz

(10) Patent No.: US 6,491,485 B2
(45) Date of Patent: Dec. 10, 2002

(54) DEVICE FOR TRANSPORTING STRUCTURES ON A RAIL CAR

(75) Inventor: Bryant Zavitz, Dunwoody, GA (US)

(73) Assignee: Tindall Corporation, Conley, GA (US)

( * ) Notice: Subject to any disclaimer, the term of this patent is extended or adjusted under 35 U.S.C. 154(b) by 0 days.

(21) Appl. No.: 09/989,612

(22) Filed: Nov. 20, 2001

(65) Prior Publication Data

US 2002/0031413 A1 Mar. 14, 2002

Related U.S. Application Data

(62) Division of application No. 09/441,839, filed on Jan. 17, 1999, now Pat. No. 6,322,301.

(51) Int. Cl.[7] ..... B60P 7/08

(52) U.S. Cl. ..... 410/91; 410/90; 410/94; 410/35

(58) Field of Search ..... 410/49, 35, 90, 410/91, 94, 80; 248/346; 296/43; 105/355, 390

(56) References Cited

U.S. PATENT DOCUMENTS

| | | | | |
|---|---|---|---|---|
| 999,828 | A | 8/1911 | McNaughton | |
| 1,814,304 | A | 7/1931 | Fitch | |
| 3,618,795 | A | 11/1971 | Burch | |
| 3,762,340 | A | 10/1973 | Udaloff | |
| 3,829,148 | A | 8/1974 | Stoneburner | |
| 4,315,707 | A | 2/1982 | Fernbach | |
| 4,737,055 | A | 4/1988 | Scully | |
| 4,805,859 | A | 2/1989 | Hudson | |
| 5,476,347 | A | 12/1995 | Shelleby | |
| 5,549,428 | A | 8/1996 | Yeatts | |
| 5,954,465 | A | 9/1999 | Ellerbush | |
| 6,012,885 | A | 1/2000 | Taylor et al. | |
| 6,027,291 | A | 2/2000 | Sain et al. | |
| 6,322,301 | B1 * | 11/2001 | Zavitz | 410/91 |

* cited by examiner

*Primary Examiner*—Stephen T. Gordon
(74) *Attorney, Agent, or Firm*—Dority & Manning

(57) ABSTRACT

A rail car transporting system is used to transport relatively heavy structures by rail car, particularly prefabricated concrete structures. At least one pair of portable retaining devices are configured to retain the structure on the rail car generally at opposite longitudinal sides thereof. Each retaining device includes a base member positionable under the structure with a vertically extending boss member configured on the base member. This boss member has a shape and size so as to fit into a recess defined in the bottom of the structure. Each of the retaining devices also includes at least one securing device that is configured to secure the retaining device to the rail car such that the structure is retained on the rail car by engagement of the boss members within the recesses.

7 Claims, 3 Drawing Sheets

DEVICE FOR TRANSPORTING STRUCTURES ON A RAIL CAR

RELATED APPLICATION

The present application is a Divisional Application of U.S. application Ser. No. 09/441,839, now U.S. Pat. No. 6,322,301, and filed on Nov. 17, 1999.

BACKGROUND OF THE INVENTION

The invention relates generally to an apparatus or system for transporting structures by rail car.

It is desirable, and often the only option, to transport relatively heavy structures, for example prefabricated building structures or modules, by rail car. For example, various types of building structures or modules are formed from precast or prefabricated concrete units. A prime example of this are prison buildings wherein the individual prison cells are modules formed from precast concrete.

These precast units are desirable in the construction industry but, however, are extremely costly to ship. The cost of "dunnage" required for securing units on the rail car for shipment can be quite high. For example, typically steel braces are fabricated and welded directly to the rail car for bracing the structures. The cost of fabricating and welding these braces can be tremendous and often prohibitive of the entire process. Additionally, the time element necessary for fabricating and welding the conventional bracing systems is also a significant disadvantage.

The present invention provides a relatively simple, inexpensive, and reusable system for transporting heavy structures, particularly prefabricated concrete structures, by rail car.

OBJECTS AND SUMMARY OF THE INVENTION

It is thus a principal object of the present invention to provide an improved apparatus or device for transporting structures via rail car.

Another important object of the present invention is to provide a rail transporting system particularly suited for prefabricated concrete structures or modules.

Additional objects and advantages of the invention will be set forth in part in the following description, or may be obvious from the description, or may be learned through practice of the invention.

The present invention provides a relatively inexpensive, efficient, and reusable apparatus or device for transporting structures, particularly prefabricated concrete structures or modules, on a rail car. The structure to be transported has a bottom side with at least two spaced apart recesses defined therein. At least one pair of portable retaining devices are configured to retain the structure on a rail car at opposite sides of the car. The retaining devices are "portable" in that they are not permanently affixed to the rail car and are reusable. Each of the retaining devices includes a base member that is positionable under the structure bottom side proximate to a longitudinal side of the rail car. A vertically extending boss member is formed on the base member. This boss member has a shape and a size so as to fit into one of the recesses in the bottom side of the structure. Each of the retaining devices also includes at least one securing device configured to secure the retaining device on the rail car so that the structure is retained on the rail car by engagement of the boss members of the two retaining devices within the recesses.

In a preferred embodiment, the base member of the retaining devices comprises a metal plate with the boss member formed on an upper surface of the metal plate.

Preferably, the retaining devices include a longitudinally extending edge. This edge is positionable proximate to a longitudinal side of the rail car. Also, each retaining device preferably includes at least two of the securing devices spaced apart along the longitudinal edge.

The securing device may comprise a downwardly extending member, such as a plate or flange member, configured on the base member, for example by being welded to the base member, bolted to the base member, etc. This downwardly extending member is slidable into a pocket or other receiving structure typically provided on a side of the rail car. The securing device further comprises a locking mechanism to lock the downwardly extending member within the pocket of the rail car. In a preferred embodiment, this locking mechanism comprises a relatively simple wedge that can be driven into the pocket and locked within the pocket to secure the retaining device relative to the rail car.

The recesses defined in the bottom side of the structure have a shape and size so as to prevent unnecessary movement of the structure relative to the boss members engaged within the recesses within the recesses. For example, the recesses may be defined as closed end channels. In this embodiment, the boss members may comprise vertically extending cylinders having a diameter generally slightly less than the width of the channels.

The present invention will be described in greater detail below through use of the appended drawings.

DETAILED DESCRIPTION

Figure 1:
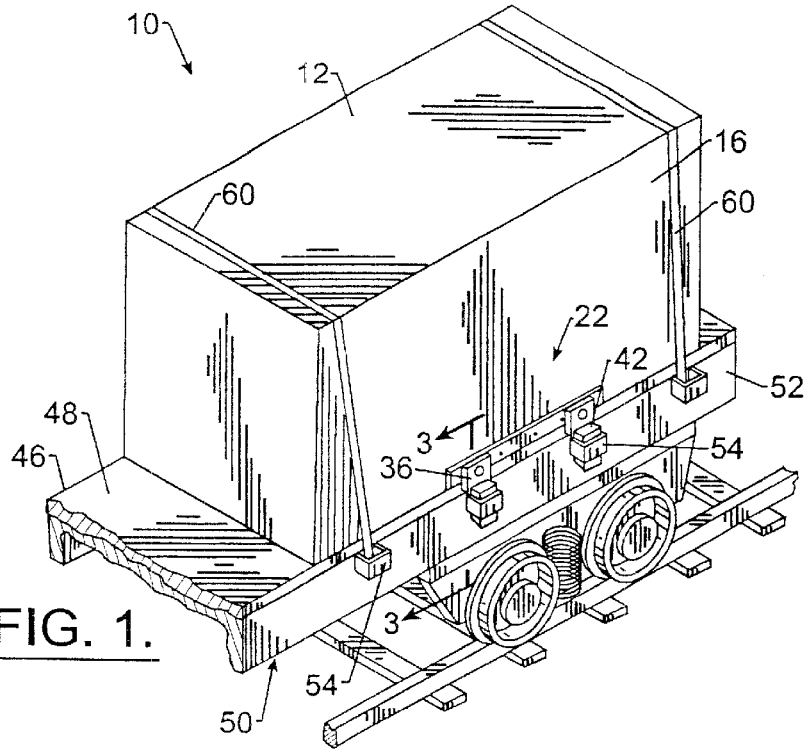
FIG. 1 is a perspective view of the rail car transporting system according to the invention.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment can be used on another embodiment to yield a still further embodiment. It is intended that the present application include such modifications and variations.

Figure 2:
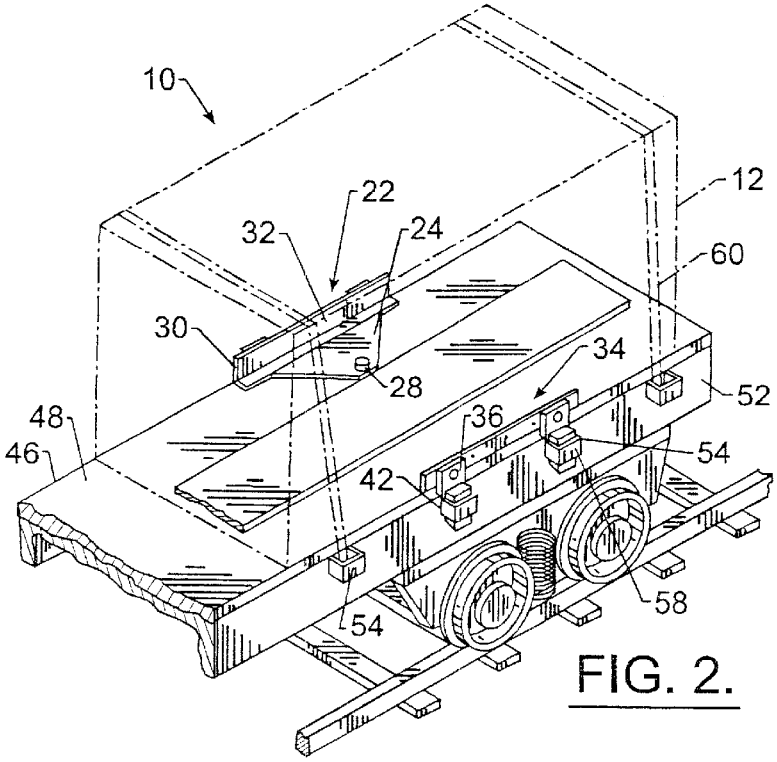
FIG. 2 is a perspective view showing the structure to be transported in phantom.

FIGS. 1 and 2 generally illustrate a rail transporting system 10 according to the invention system 10 is utilized to transport structures, generally 12, by a rail car 46. The type of structure 12 is not a limiting factor of the invention. The invention is particularly suited for transporting prefabricated concrete building structures or modules, for example prison cell modules, by rail car. However, it should be appreciated that the transporting system may be utilized in a any environment wherein relatively heavy or bulky structures are desired to be transported by rail car. All such uses and environments are within the scope and spirit of the invention. For sake of explanation only, structure 12 is illustrated in the figures as a prefabricated concrete structure having a generally rectangular shape.

The present invention is also not limited to any particular type of rail car 46. Conventional flat or bulkhead rail cars 46 define a generally open or planar top surface and longitudinal sides 50 defined by, for example, side sills 52. Typically, a plurality of pocket-type members 54 or other similar structure are provided longitudinally along sill 52. These structures are typically used for securing hold down straps 60 or other securing devices. These conventional pockets 54 or similar structure may also be utilized with the present invention. In the embodiment illustrated, pockets 54 are generally open ended sleeve-type members. It should be appreciated, however, that various structures may be utilized as the pocket member according to the invention.

Transporting system 10 includes at least one pair of portable retaining devices, generally 22, that are configured to retain structure 12 on rail car 46 at the opposite longitudinal sides of the rail car. Retaining devices 22 are "portable" in that they are not permanently affixed to rail car 46 and are reusable. In a preferred embodiment illustrated in the figures, each retaining device 22 comprises a base member 24. Base member 24 may be defined by, for example, a plate member or sheet metal member.

Figure 3:
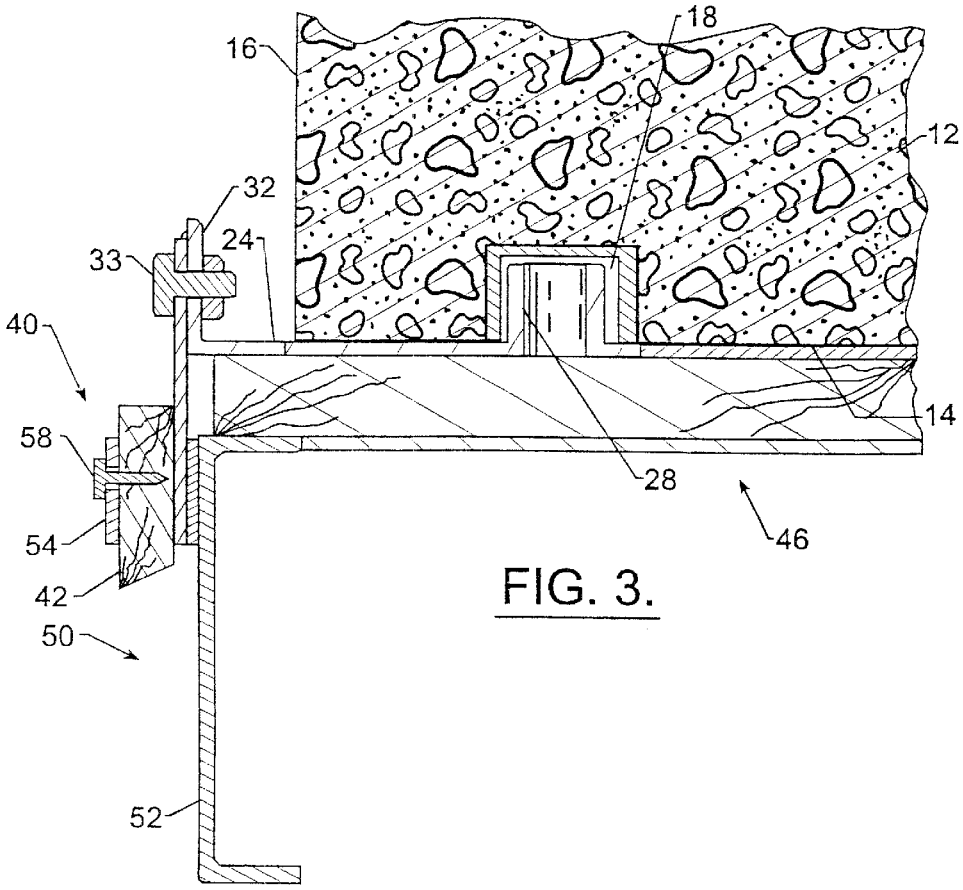
FIG. 3 is a side cut-away view taken along the lines indicated in FIG. 1.

Base member 24 is positionable under a bottom side or surface 14 of structure 12, as particularly illustrated in FIGS. 2 and 3. In this manner, the pair of retaining devices 22 would be positioned on rail car 46 prior to loading structure 12 onto the rail car.

Figure 4:
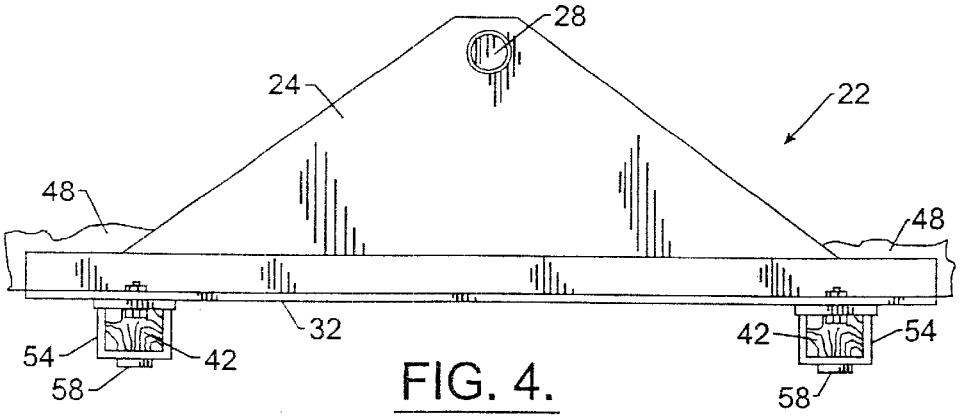
FIG. 4 is a top view of the retaining device according to the invention as used with the rail car.
Figure 5:
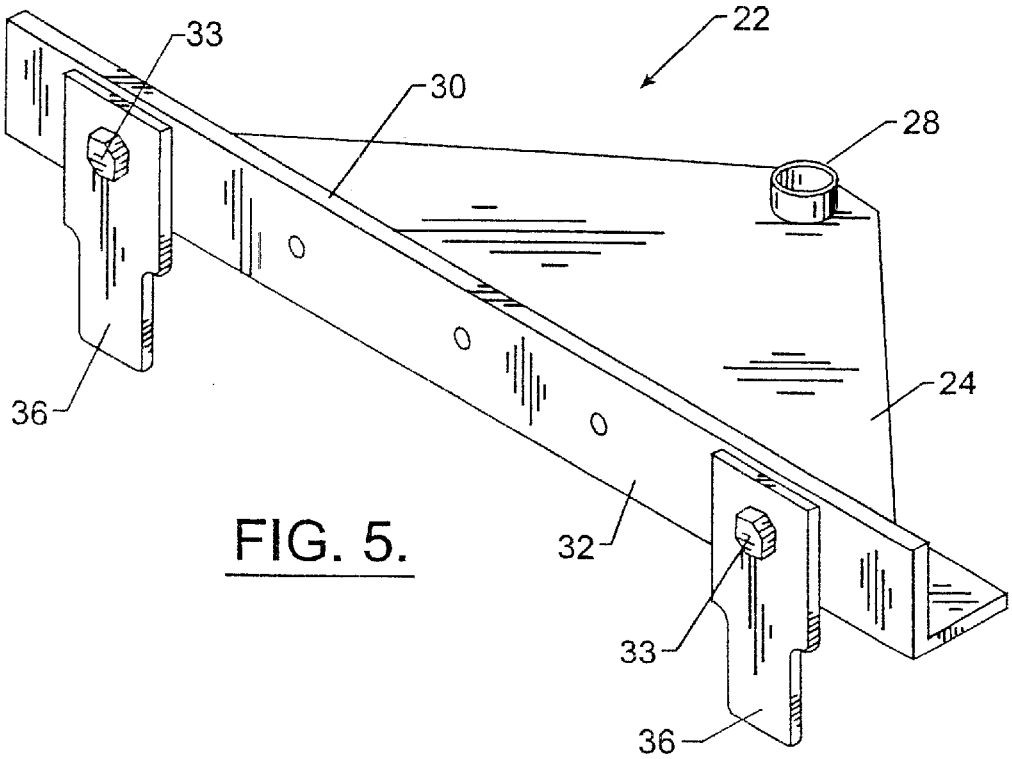
FIG. 5 is a perspective view of one of the retaining devices according to the invention.

Referring to FIGS. 4 and 5 in particular, each retaining device 22 also includes an upwardly standing boss member 28. Boss member 28 may take on any shape or configuration and is illustrated in the figures as a cylindrical member. More than one boss member 28 may be provided with each retaining device 22. Boss members 28 are displaced from a longitudinal side or edge 30 of retaining device 22. Longitudinal edge 30 may be defined by, for example, a flange type member 32 having an upwardly extending portion, as particularly illustrated in FIGS. 3 and 5. Edge 30 or flange 32 is positionable along the longitudinal side of the top surface 48 of rail car 46, as particularly illustrated in FIG. 2.

Referring particularly to FIG. 3, boss members 28 are spaced from edge 30 or flange 32 and have a shape and size so as to fit within a recess 18 defined in bottom surface 14 of structure 12. Recess 18 has a shape and size so as to limit movement of structure 12 relative to boss member 28 when structure 12 is placed on retaining devices 22. For example, recess 18 may be defined as a channel having a width generally slightly greater than the diameter of cylindrical boss member 28, as particularly illustrated in FIG. 3. The channel configuration may be desirable particularly if at least two boss members 28 are provided and longitudinally aligned on each retaining device 22. Thus, it should be understood that at least two recesses 18 are defined in the bottom surface of structure 12 and are spaced apart generally proximate to longitudinal sides 16 of structure 12 so as to be engaged by boss members 28 of opposite retaining devices 22.

In an alternate embodiment, the recess 18 may have a width substantially greater than the diameter of boss member 28. This may be desirable to accommodate various size boss members or provide a degree of transverse play in positioning the structure or the retaining devices. With this embodiment, it may also be desired to use blocks or like devices between the sides of the structure and flange member 32 to prevent movement of the structure relative to the retaining devices.

Each retaining device 22 also incorporates at least one securing device, generally 34, to removably attach or secure retaining device 22 relative to rail car 46. A preferred embodiment of this securing device is illustrated in the figures and includes at least two downwardly extending members 36 connected to the longitudinal edge of each retaining device 22. For example, referring to FIG. 5, downwardly extending members 36 may be finger-like flange members bolted (lugs 33), welded, or otherwise attached to and longitudinally spaced along flange member 32. Referring particularly to FIG. 3, downwardly extending members 36 have a shape and length so as to extend into a pocket member 54. Pocket members 54 may be conventional sleeve type members provided on rail car 46 or may be otherwise configured on the rail car for purposes of the present invention.

A locking mechanism, generally 40, is utilized to secure members 36 within pockets 54. Any manner of type of locking mechanism may be utilized in this regard. An embodiment of the locking mechanism 40 illustrated in the figures includes a relatively simple wooden wedge 42 that is driven into pockets 54 so as to wedge and securely hold members 36 therein. A spike 58 is then driven into the wedge through a hole in the front face of pocket 54 to securely hold the wedge in place. Thus, in this manner, the retaining device is securely mounted relative to the rail car 46 yet is easily removable by simply removing spike 58 and wedge 42. This process is easy, requires very little time, and allows for immediate reuse or storage of the portable retaining devices.

Once the retaining devices 22 have been configured on rail car 46 as described above, the structure 12 is simply lowered onto rail car 46. Care must be taken to properly position structure 12 relative to the rail car so that boss members 28 engage within recesses 18. As mentioned above, it may be desirable to define recesses 18 as channels so that a degree of "play" or adjustment is provided in positioning structure 12.

The present invention also pertains to a retaining system for securing a structure on a rail car, for example the retaining devices as discussed above. In other words, the retaining system or devices without regards to any particular structure is within the scope and spirit of the invention.

The assignee of the present application has found that the retaining system and rail car transporting system as described herein significantly reduces the cost, time, and complexity of transporting prefabricated modules via rail car, particularly prefabricated prison cell modules, thereby making it far more economical to transport such structures by rail car.

It should be appreciated by those skilled in the art that various modifications and variations can be made in the present invention without departing from the scope or spirit of the invention. For example, the retaining devices according to the invention can take on any manner of shape or configuration to serve the function as described herein. It is intended that the present invention include such modifications and variations as come within the scope and spirit of the appended claims.

What is claimed is:

1. A retaining system for securing a structure on a rail car; said system comprising:

at least two retaining devices removably placeable along opposite sides of a rail car;

each said retaining device further comprising a base member positionable on an upper surface of the rail car proximate to a longitudinal side of the rail car, and an upwardly extending boss member formed on said base member, said boss member having a shape and size so as to fit into a recess defined in a bottom surface of the structure; and each of said retaining devices also comprising at least one securing device configured to removably secure said retaining device to the rail car such that the structure is sandwiched between said retaining devices and retained on the rail car by engagement of said boss members within respective recesses defined in the bottom surface of the structure, said securing device extending downwardly from said base member and configured so as to overhang the longitudinal side of the rail car and secure said retaining device to a longitudinally extending side member of the rail car.

2. The system as in claim 1, wherein said base member comprises a metal plate, said boss member formed on said metal plate.

3. The system as in claim 1, wherein said retaining devices comprise a longitudinally extending edge, and further comprising at least two said securing devices spaced apart along said edge.

4. The system as in claim 1, wherein said securing device is slidable into a pocket provided on a side of a rail car.

5. The system as in claim 4, further comprising a locking mechanism to lock said downwardly extending member within the pocket of a rail car.

6. A retaining system for securing a structure on a rail car; said system comprising:

at least two retaining devices removably placeable along opposite sides of a rail car;

each said retaining device further comprising a base member positionable on an upper surface of the rail car proximate to a longitudinal side of the rail car, and an upwardly extending boss member formed on said base member, said boss member having a shape and size so as to fit into a recess defined in a bottom surface structure;

each of said retaining devices also comprising at least one securing device configured to removably secure said retaining device to the rail car such that the structure is sandwiched between said retaining devices and retained on the rail car by engagement of said boss members within respective recesses defined in the bottom surface of the structure;

wherein said securing device comprises a downwardly extending member formed on said base member, said downwardly extending member slidable into a pocket provided on a side of a rail car;

a locking mechanism to lock said downwardly extending member within the pocket of a rail car; and wherein said locking mechanism comprises a wedge.

7. A system for transporting a prefabricated concrete structure on a rail car, wherein the structure has a bottom side with at least two spaced apart recesses defined therein positionable proximate to sides of a rail car upon being placed thereon, said system comprising:

at least one pair of retaining devices removably attachable to opposite sides of a rail car and configured to retain the structure on an upper surface of the rail car; each of said retaining devices further comprising a base member positionable under a bottom side of the structure proximate to a longitudinal side of a rail car, and a boss member vertically extending from said base member, said boss member having a shape and size so as to fit into one of the recesses in the structure;

said base member further comprising a longitudinally extending side member positionable along the longitudinal side of the rail car; and at least two securing devices spaced apart on said side member, said securing devices removably securing said retaining devices to said rail car, said securing devices extending downwardly from said base member and configured so as to overhang the longitudinal side of the rail car and secure said retaining device to a longitudinally extending side member of the rail car.

* * * * *